US009039460B2

(12) United States Patent
Hackemack et al.

(10) Patent No.: US 9,039,460 B2
(45) Date of Patent: May 26, 2015

(54) TERMINAL BLOCK ASSEMBLY WITH A PLURALITY OF TERMINAL BLOCKS HELD SIDE BY SIDE BY A PAIR OF END CONNECTING UNITS

(71) Applicant: Weidmueller Interface GmbH & Co. KG, Detmold (DE)

(72) Inventors: Frank Hackemack, Detmold (DE); Joerg Richts, Schlangen (DE); Bernhard Jaschke, Lage (DE); Roetger Sander, Bad Sassendorf (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 47 days.

(21) Appl. No.: 14/087,115

(22) Filed: Nov. 22, 2013

(65) Prior Publication Data

US 2014/0148035 A1 May 29, 2014

(30) Foreign Application Priority Data

Nov. 28, 2012 (DE) ..... 20 2012 104 617 U

(51) Int. Cl.
*H01R 9/26* (2006.01)
*H01R 9/16* (2006.01)
*H01R 13/74* (2006.01)

(52) U.S. Cl.
CPC ..... *H01R 9/16* (2013.01); *H01R 9/2616* (2013.01); *H01R 9/2608* (2013.01); *H01R 9/2666* (2013.01); *H01R 13/74* (2013.01)

(58) Field of Classification Search
USPC ..... 439/712–717
See application file for complete search history.

(56) References Cited

U.S. PATENT DOCUMENTS

| | | | | | |
|---|---|---|---|---|---|
| 2,884,613 | A * | 4/1959 | Chandler, Jr. et al. | ..... | 439/717 |
| 3,253,251 | A * | 5/1966 | Norden | ..... | 439/716 |
| 3,317,886 | A * | 5/1967 | Norden | ..... | 439/716 |
| 5,629,831 | A * | 5/1997 | Eggert et al. | ..... | 361/624 |
| 5,651,702 | A * | 7/1997 | Hanning et al. | ..... | 439/715 |
| 5,987,203 | A | 11/1999 | Abel et al. | | |
| 6,692,292 | B2 * | 2/2004 | Huiskamp et al. | ..... | 439/417 |
| 7,402,075 | B1 * | 7/2008 | Probst | ..... | 439/410 |

(Continued)

FOREIGN PATENT DOCUMENTS

| | | |
|---|---|---|
| DE | 21 02 782 A | 7/1971 |
| DE | 29 29 371 A1 | 1/1981 |

(Continued)

*Primary Examiner* — Chandrika Prasad
(74) *Attorney, Agent, or Firm* — Lawrence E. Laubscher, Sr.; Lawrence E. Laubscher, Jr.; Robert D. Spendlove

(57) ABSTRACT

A terminal block arrangement includes a plurality of generally rectangular terminal blocks having vertical parallel side walls, vertical end walls, and horizontal top and bottom walls, a connecting arrangement connecting said terminal blocks in contiguous side-by-side stacked relation, thereby to define a terminal block assembly in which at least portions of the terminal block top and bottom walls are exposed, and a fastening arrangement for fastening the bottom portion of the terminal block assembly to a fixed support. In a first embodiment, the fastening arrangement includes vertically displaceable end support members arranged at each end of the terminal block assembly, each support member having pairs of support feet arranged for connection with the fixed support. In a second embodiment, an adapter plate is secured to the fixed support, and the terminal block assembly is fastened to the adapter plate.

8 Claims, 20 Drawing Sheets

(56) References Cited

U.S. PATENT DOCUMENTS

| | | | | |
|---|---|---|---|---|
| 7,695,324 | B2 * | 4/2010 | Diekmann | 439/721 |
| 8,715,017 | B1 * | 5/2014 | Barber et al. | 439/716 |
| 2009/0221187 | A1 | 9/2009 | Daly et al. | |
| 2014/0077832 | A1 * | 3/2014 | Hackemack et al. | 324/755.05 |

FOREIGN PATENT DOCUMENTS

| | | | |
|---|---|---|---|
| DE | 44 02 001 | A1 | 7/1995 |
| DE | 197 14 868 | A1 | 10/1998 |
| DE | 101 40 243 | C1 | 1/2003 |

* cited by examiner

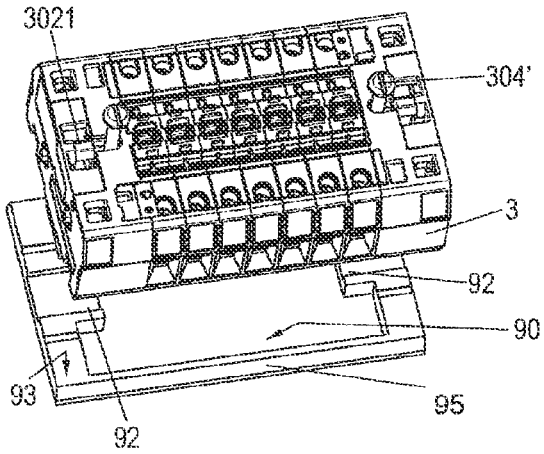
Fig. 9a
Fig. 9b
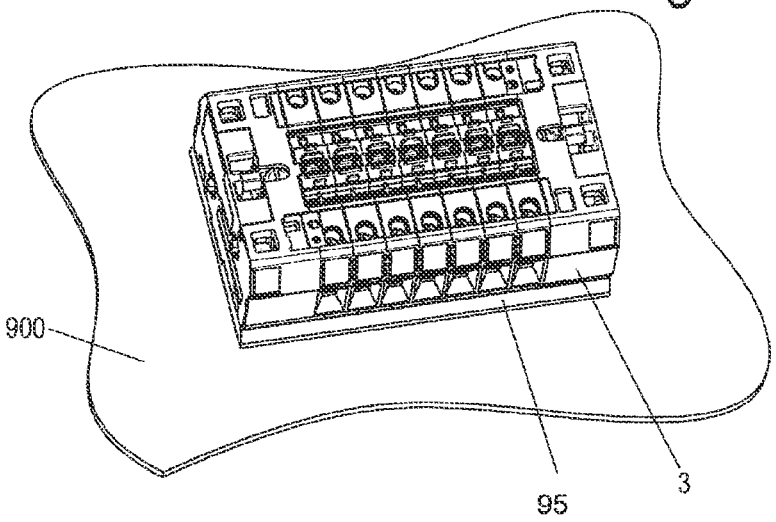
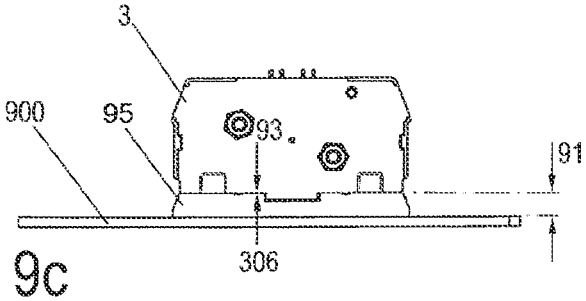
Fig. 9c

TERMINAL BLOCK ASSEMBLY WITH A PLURALITY OF TERMINAL BLOCKS HELD SIDE BY SIDE BY A PAIR OF END CONNECTING UNITS

REFERENCE TO RELATED APPLICATIONS

This application claims priority of the German application No. DE 20 2012 104 617.2 filed Nov. 28, 2012. It is a companion application to U.S. application Ser. No. 14/119,968 filed Nov. 25, 2013. which is based on International Application PCT/EP 2012/059383 filed May 21, 2012, claiming priority of the German application No DE 20 2011 101 414.6 filed Jun. 3, 2011; and to U.S. application Ser. No. 14/'123, 212 filed Nov. 30, 2013 which is based on International application No. PCT/EP2012/059392 filed May 21, 2012, claiming priority of German application No. DE 20 2011 101 414.6 filed Jun. 3, 2011.

BACKGROUND OF THE INVENTION

1. Field of the Invention

A terminal block arrangement includes a plurality of generally rectangular terminal blocks having vertical parallel side walls, vertical end walls, and horizontal top and bottom walls, a connecting arrangement connecting said terminal blocks in contiguous side-by-side stacked relation, thereby to define a terminal block assembly in which at least portions of the terminal block top and bottom walls are exposed, and a fastening arrangement for fastening the bottom portion of the terminal block assembly to a fixed support.

2. Description of Related Art

In controls engineering, connection devices are often used that consist of a plurality of terminal blocks ranged in a row, which are provided for the connecting of electrical conductors. Such connection devices allow an installer, for example, to perform a quick reconfiguration in event of a product change on an assembly line. Usually the connecting devices are arranged on mounting rails, from which they can be removed with a few manual operations. A mounting in wall recesses is also often possible.

In addition to provide an improvement in these prior mounting arrangements, the present invention was developed to provide an arrangement that further enables the mounting of such a connection device on a closed wall.

SUMMARY OF THE INVENTION

Accordingly, a primary object of the invention is to provide a terminal block arrangement including a plurality of generally rectangular terminal blocks having vertical parallel side walls, vertical end walls, and horizontal top and bottom walls, a connecting arrangement connecting said terminal blocks in contiguous side-by-side stacked relation, thereby to define a terminal block assembly in which at least portions of the terminal block top and bottom walls are exposed, and a fastening arrangement for fastening the bottom portion of the terminal block assembly to a fixed support. In a first embodiment, the fastening arrangement includes vertically displaceable end support members arranged at each end of the terminal block assembly, each support member having pairs of support feet arranged for connection with the fixed support. In a second embodiment, an adapter plate is secured to the fixed support, and the terminal block assembly is fastened to the adapter plate.

According to a more specific object, the connecting arrangement includes a pair of end connecting units that are arranged at opposite ends of a stack of terminal blocks arranged side-by-side, with longitudinal locking bars extending through the terminal block stack for connection at their ends with the end connecting units, respectively. End support members carrying pairs of mounting feet are mounted in the end connecting members for vertical displacement between an extended lower connecting/disconnecting position and a retracted upper locking position. When the end support member is in the extended lower position, the connector arrangement may be connected by the mounting feet either to the mounting rail or to the wall opening, whereupon the end support member is raised by screw operating means to the retracted locking position, thereby fastening the connector arrangement to the fixed support.

A further object is to provide a fastening arrangement including an adapter plate secured to an imperforate wall surface, and screw means for attaching the connector assembly to the adapter plate. Preferably, the attachment plate is flat in configuration on its side away from the terminal block assembly, so that it designed for mounting of the connector assembly on a flat base. In theory, however, a surface contour of the side of the adapter plate away from the connector assembly is also preferred, being uneven and adapted to a surface contour of the base.

Preferably, the adapter plate contains a cutout opening for receiving elements of the connector assembly. As a result, elements of the connector assembly that are elevated above an imaginary mounting plane are accommodated in the cutout opening. Owing to the cutout opening in the adapter plate, it is designed to accommodate the mounting elements such as the mounting feet, whereby the connector assembly can be mounted on a base, preferably against a wall, without damaging the elements. For this reason, the height of the elements accommodated in the cutout is preferably less than the thickness of the adapter plate. Especially preferably, the arrangement is mounted on a closed wall.

It is preferable for the adapter plate to have a surface contour on its side facing the connector assembly, configured to be at least partly corresponding to a surface contour of the bottom side of the connector assembly. Especially preferably, the connector assembly lies at least partly, preferably with a marginal area, fully against the adapter plate. In this configuration, the surface contour of the adapter plate in the marginal region follows the surface contour of the connector assembly. It is preferable for the marginal region to be closed in configuration, so that it fully encloses the cutout. This hinders the penetration of dust and moisture into the cutout.

The connector assembly has, as the elements accommodated in the cutout, at least two sets of support feet, which are provided for fastening the connection device either on a mounting rail, or in a wall cutout. The connector assembly is therefore mountable either on the mounting rail, in the wall cutout, or on the closed wall. The support feet have mounting rail support sections for a mounting of the connector assembly on a mounting rail, and wall bracket sections for a wall mounting of the connection device in the wall cutout. Therefore, both the mounting rail mounting and the wall mounting in the wall cutout are very easy to perform. The connector assembly can preferably be screwed or locked onto the adapter plate, and therefore again it can be very easily mounted on the closed wall.

For the mounting of the connector assembly, this preferably has an end support unit that can be mounted side by side with the terminal block stack, in which again preferably there is arranged one holding element with two pairs of support feet each. Furthermore, it is preferred that the connector assembly have two such holding units, which are arranged especially preferably at opposite ends of the connector assembly, so that they are spaced apart from each other.

Preferably the support unit has a seat for a shifting means, especially a screw. Preferably, the connection device is fastened with the shifting means to the adapter plate. It is preferable that the shifting means be used for moving the holding element against the mounting direction, so that it also serves to fasten the connection device to the mounting rail or the wall cutout.

According to another feature, the connector assembly includes two electrically contacting leaf spring contacts that are when the testing device is inserted. Therefore, when the testing device is inserted into the connector assembly, the voltage on the contact tabs is preferably placed against the contact plates of the connector units. According to an important feature of the invention, the testing device can be inserted alternatively from a top side of the connector assembly, or from the bottom side of the connector assembly. This allows for a more diversified use of the arrangement. The terminal blocks are configured with first and second contact tabs for either sided inserting of a testing device from a top side of the connection device and a bottom side of the connection device. If the second contact tabs are arranged one above the other with the first electrically contacting contact tabs, there is an even greater opportunity for attaching the testing device, and additional or complicated constructions are no longer needed.

The second contact tabs and the first electrically contacting contact tabs are electrically switched in parallel. This is easily possible inside the connection device, so that it will not increase its volume. It is advisable for the second contact tabs or the first electrically contacting contact tabs to be electrically separated by a removable plug element. This removable plug element makes it possible to easily adapt the connection device to its particular use by re-plugging, without any other design being required.

The connector assembly has at least one protection element, movable from a first position in which it closes activating segments for clamping units of the connection device arranged underneath into a second position in which the activating segments are accessible. This enables a quick and easy manipulation protection.

According to another feature of the invention, at least one protection element is held in a guide of a housing of the connection device able to shift in the lengthwise direction. Such a configuration is easy and with it the protection element can be moved easily and quickly.

It is provided in this case that the at least one protection element has a cover field with one cover opening per clamping unit. In this way, a protection element can be adapted for a given number of clamping units by easy adjustment of the length.

BRIEF DESCRIPTION OF THE DRAWINGS

Other objects and advantages of the invention will become apparent from a study of the following specification, when viewed in the light of the accompanying drawing, in which:

FIGS. 8*c*-8*i* are side elevation views, with certain parts removed, illustrating the operation of the end support member;

FIG. 9*a* is an exploded perspective view illustrating the arrangement of the terminal block assembly on an adapter plate;

FIG. 9*b* is a perspective view illustrating the manner in which the adapter plate connects the terminal block assembly to an imperforate wall surface;

FIG. 9*c* is an end view of the apparatus of FIG. 9*b;*

DETAILED DESCRIPTION OF THE INVENTION

Figure 1:
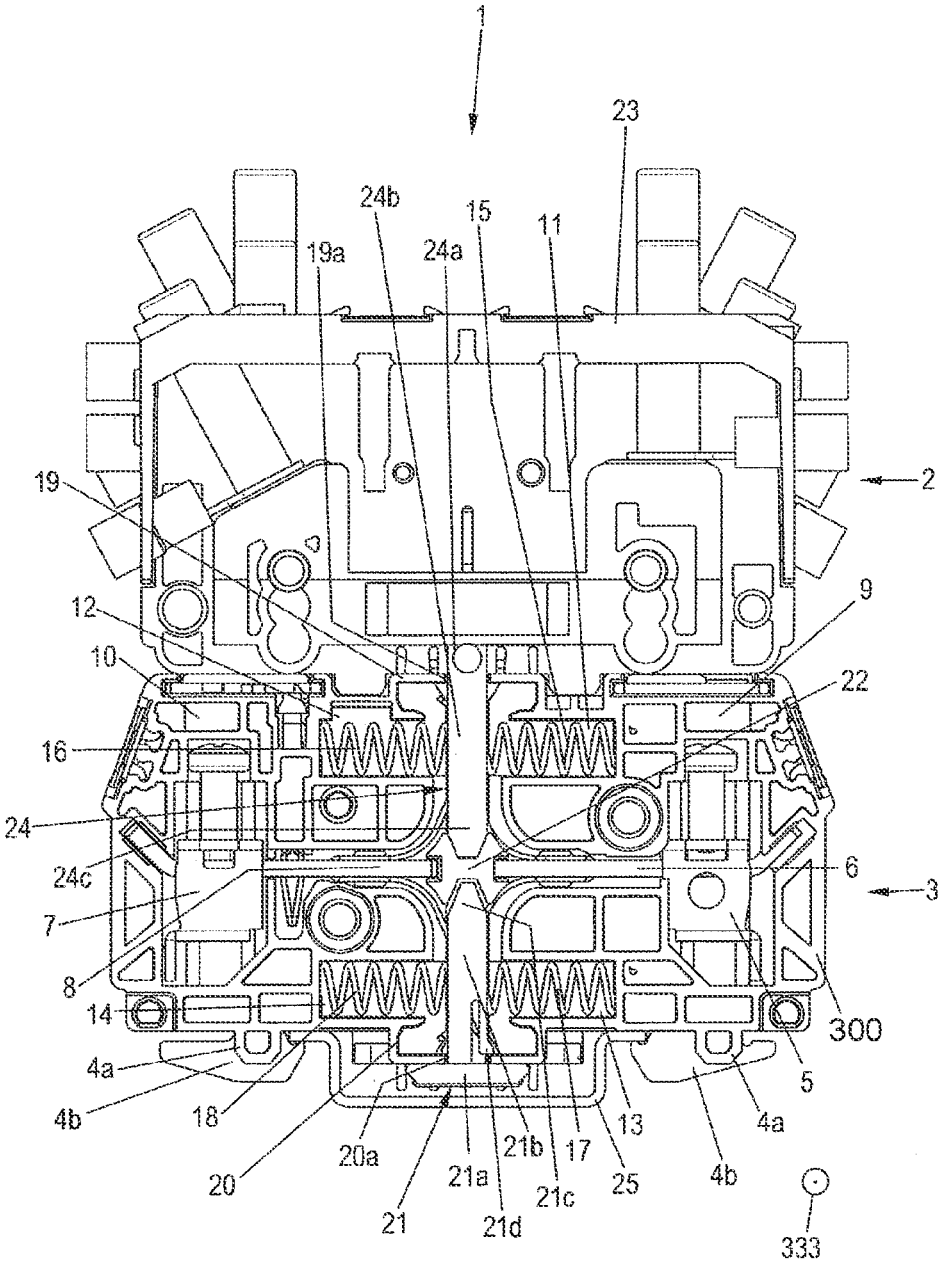
FIG. 1 is a partly sectioned view of testing arrangement with the terminal block assembly mounted on a mounting rail, and with the testing device mounted above the terminal block assembly.

Referring first more particularly to FIG. 1, the terminal block testing arrangement 1 includes a testing device 2 for testing a terminal block assembly 3 that is mounted on a mounting rail 25. The terminal block assembly includes a stack of terminal blocks 300 arranged in stacked side-by-side relation, which components are connected by connecting means 4 (FIG. 4*a*) to define the assembly 3, as will be described below. Each terminal block 300 has a rectangular body formed of thermoplastic insulating synthetic material, as is known in the art. The terminal block body includes chambers that contain a pair of horizontal coplanar conductive bus bar members 6 and 8 that are separated at their adjacent ends by an electrically insulating spacer member 22. At their remote ends, the bus bars are connected with screw-operated clamp devices 5 and 7, respectively, that connect with the bus bars the bare ends of conductors (not shown) that extend normal to the terminal block. Access chambers 9 and 10 are provided in the upper wall of the terminal block above the clamp devices 5 and 7, respectively, which chambers are closed by the protective slide members 27 (FIGS. 4*a* and 4*b*).

Connected with the upper surfaces of the bus bars 5 and 7 are upper leaf spring contacts 15*b* and 16*b* (FIG. 3) having upper tip portions 15*a* and 16*a* that are biased toward electrical engagement by compression springs 15 and 16 mounted in the terminal block. Similarly, there are connected with the lower surfaces of the bus bars the lower leaf spring contacts 17*b* and 18*b* which are biased toward electrical engagement by the compression springs 17 and 18, respectively. In FIG. 1*a*, the tips of these lower leaf spring contacts are separated by the dummy insulating pins 21 having locking tabs 21*a*, and the tips of the upper leaf spring contacts are separated by the insulated test plug 24 of the testing device 2 inserted through opening 19*a* contained in the terminal block top wall, whereby the bus bars 6 and 8 are in a disconnected testing condition.

The testing device 2 serves for testing and measuring electrical quantities of electrical appliances hooked up to the terminal block assembly, which shall not be described in further detail. The testing device 2 has a housing 23, and is not further described. In the housing are arranged not otherwise specified plug and switch devices for testing and/or measuring purposes. On the bottom side of the testing device 2 are arranged pin elements 24, of which only one is shown here as an example for all the others. With these pin elements 24 and optionally other switches, which will not be discussed further, the testing device 2 is inserted into the connection device 3. As will be described in greater detail below, the bottom portion of the terminal block connecting means 4 is provided at opposite ends with pairs of mounting feet 4*a* (FIG. 8*a*) that serve to mount the assembly on the inverted hat-shaped mounting rail 25.

Figure 4A:
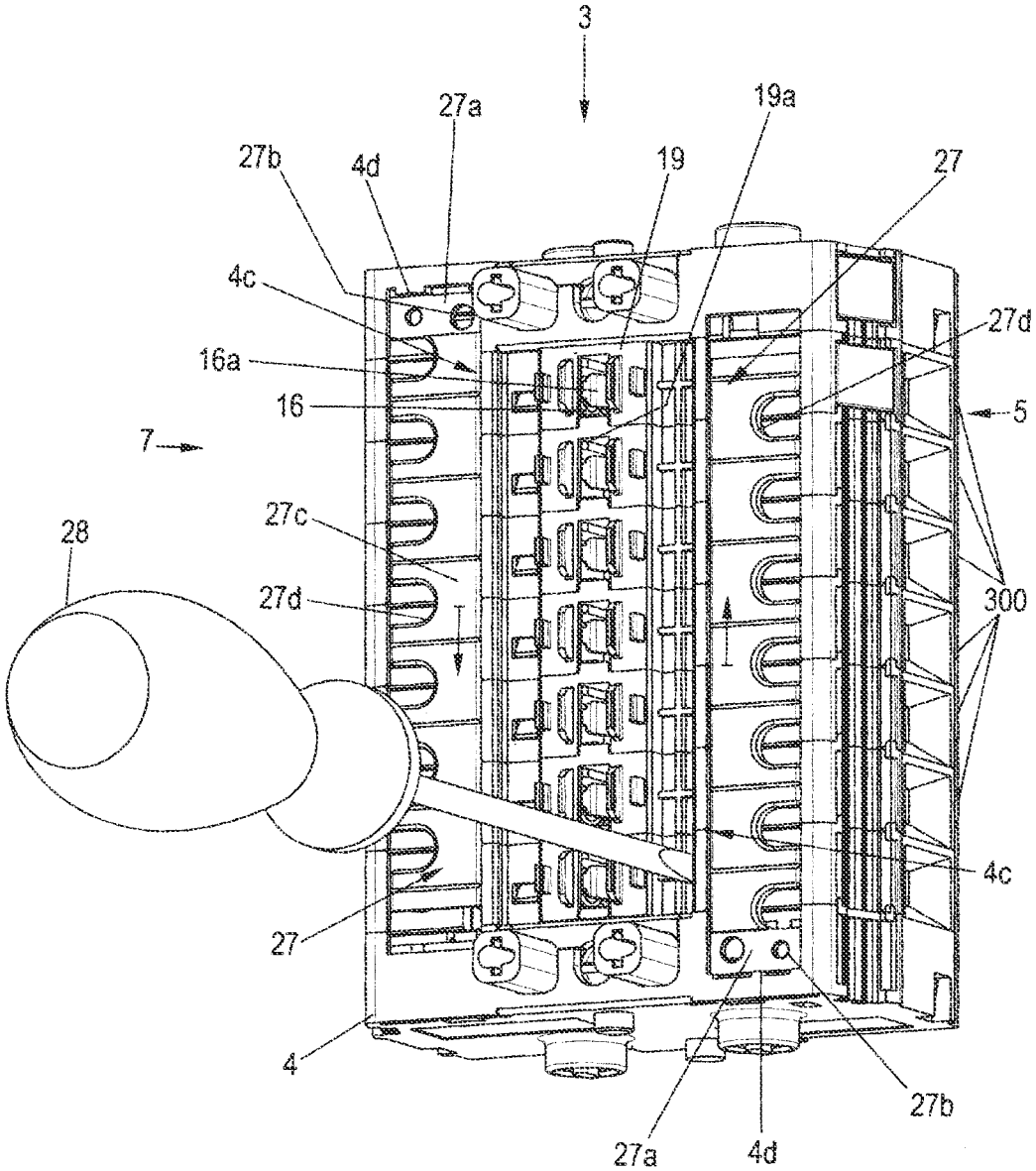
FIG. 4*a* is a top perspective view of the terminal block assembly, together with an operating tool for adjusting the protective covers when in the closed position.
Figure 4B:
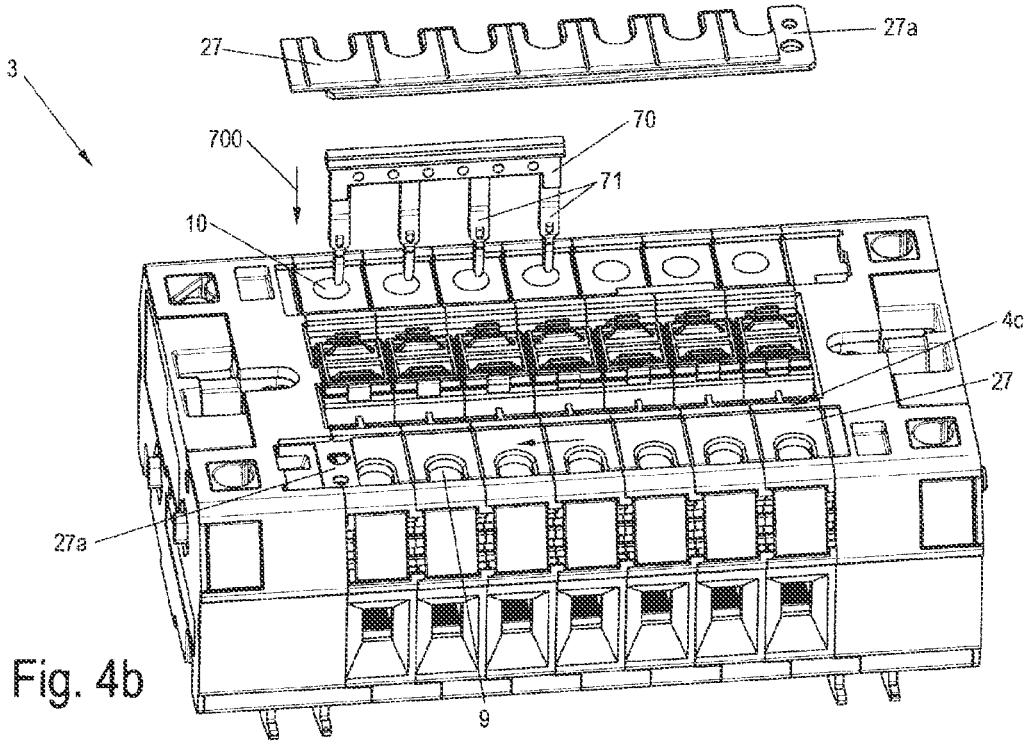
FIG. 4*b* is a partially exploded perspective view of the terminal block assembly.
Figure 8A:
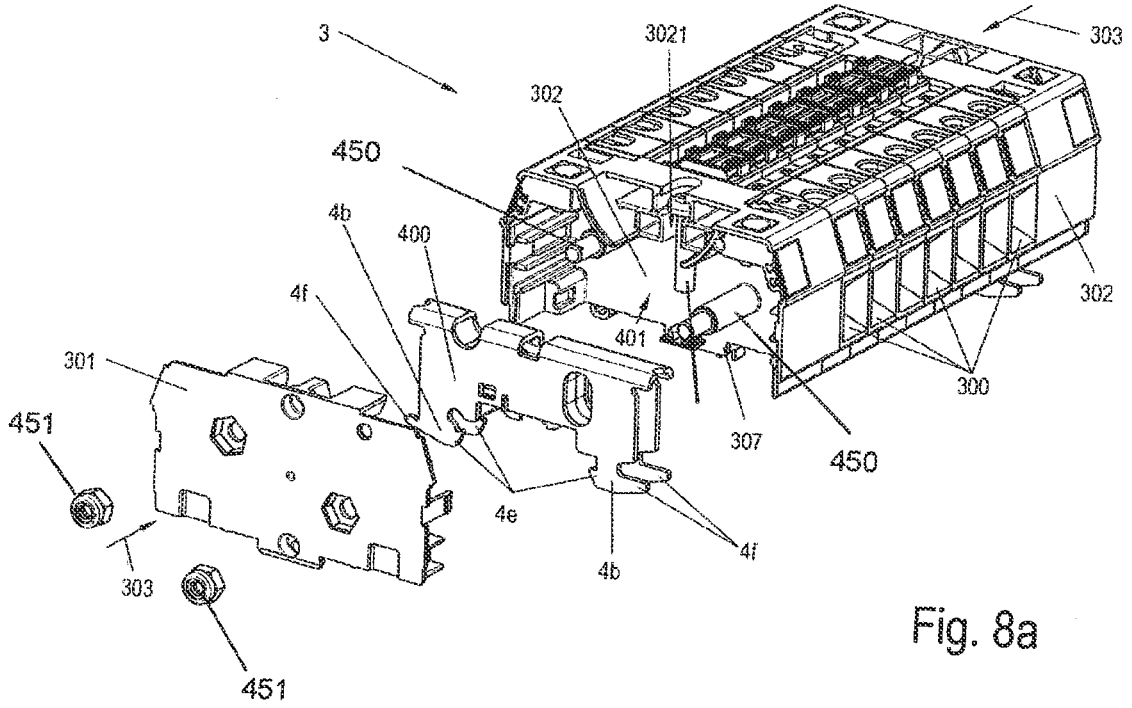
FIG. 8*a* is an exploded end perspective view of the terminal block assembly.

As shown in FIGS. 4*a* and 8*a*, the terminal block assembly 3 includes a stack of seven terminal blocks 300 that are connected together by connecting means 4. As will be described below, these connecting means include a pair of end units 302 (FIG. 8*a*) that are connected together by longitudinal locking rods 450 that extend through openings in the terminal block stack. The terminal blocks 300 are designed for connection with electrical conductors (not shown), which can be introduced essentially at right angles to the longitudinal axis of the assembly 3 (which is normal to the plane of the drawing in FIGS. 1 and 2) from either side into the connector units 300 and fastened in clamping units 5 and 7. The clamping units 5 and 7 in this sample embodiment are shown as one pair, but of course even larger numbers of pairs are possible.

Figure 2:
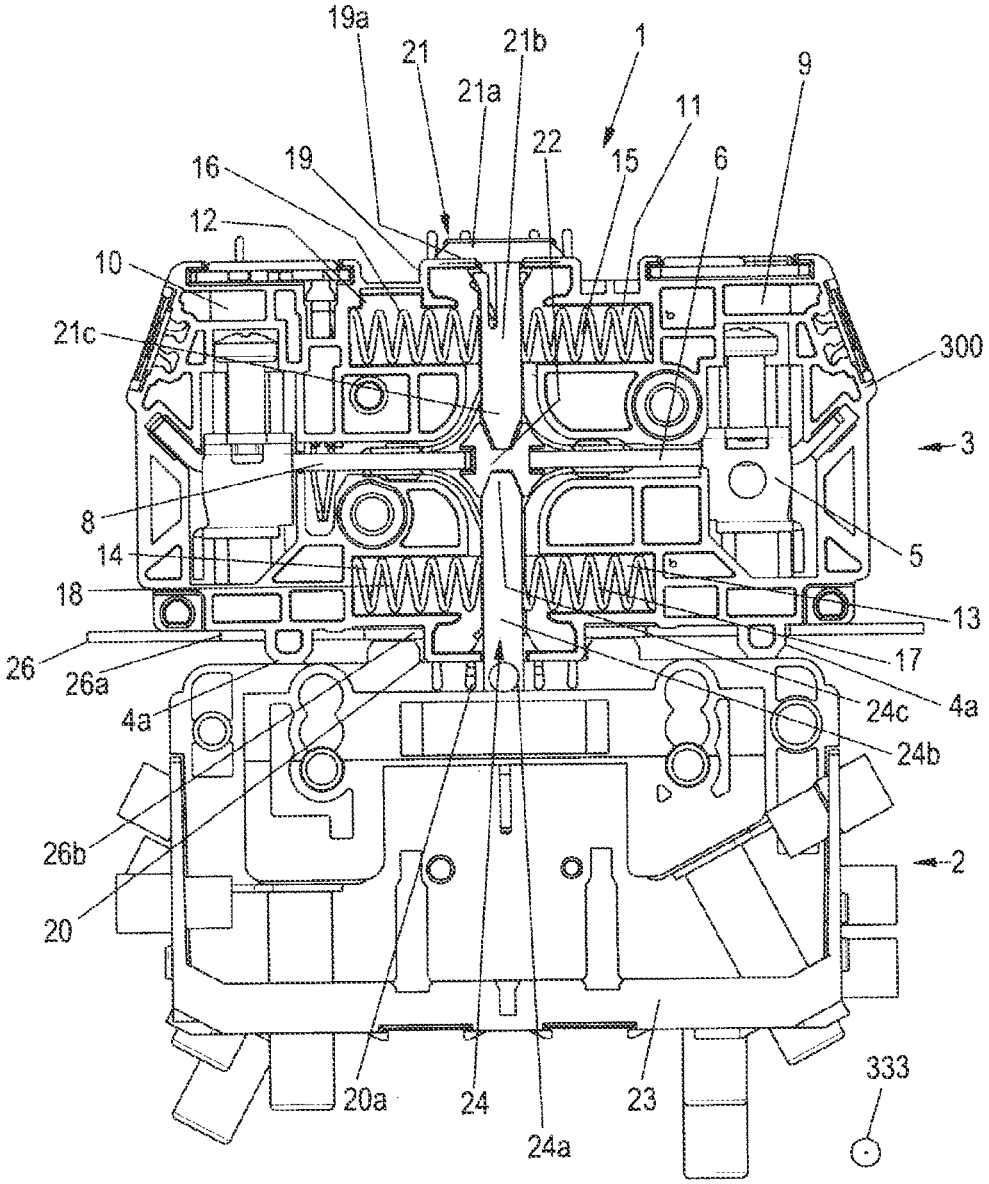
FIG. 2 is a partly sectioned view with the terminal block assembly arranged above an opening contained in a fixed support wall, and with the testing device mounted below the terminal block assembly and below the support wall, a dummy plug being inserted via an opening contained in the top wall of the terminal block.

Referring now to FIG. 2, the terminal block assembly 3 of FIG. 1 is arranged above an opening 26*a* contained in horizontal wall 26, and the testing device is inverted and arranged below the wall opening, with the test plug 24 extending upwardly through an opening 20*a* contained in the terminal block lower wall to effect separation of the leaf spring contacts 17*a* and 18*a*. A dummy plug 21 is inserted downwardly through the upper wall opening 19*a* to effect separation of the upper pair of leaf spring contacts 15*b* and 16*b*. The terminal block support feet 4*a* and the lower central portion of the terminal block extend into the wall opening 26*a*. Thus, the connection device 3 can be assembled with the testing device 2 from either side.

Figure 3:
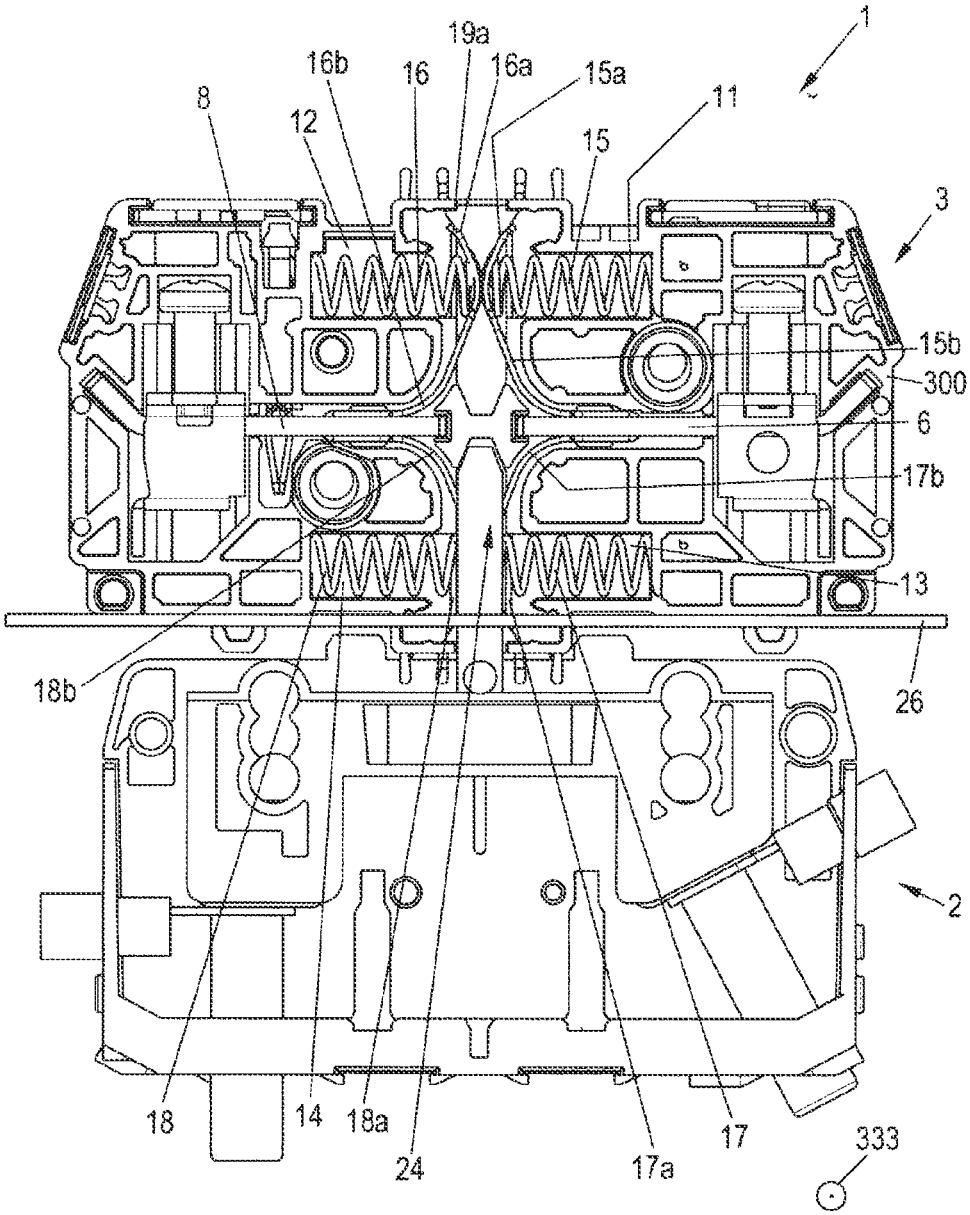
FIG. 3 is a partly sectioned view corresponding to FIG. 2 with the dummy plug removed.

FIG. 3 shows a schematic section view of the second sample embodiment of FIG. 2 with first and second contact tabs 15*a*, 16*a*, 17*a*, 18*a*. The first and second contact tabs 15*a*, 16*a* and 17*a*, 18*a* face each other as pairs between the first compression springs 15 and 16, and the second compression springs 17, 18. The second contact tabs 15*a* and 16*a* make contact, since as of yet no plug element 21 has been inserted. The first and second contact tabs 15*a*, 16*a* and 17*a*, 18*a* have spring segments 15*b*, 16*b*, 17*b*, 18*b*, by which they are secured in electrically conducting manner on the bus bars 6 and 8. Therefore, in mirror image to the bus bars 6, 8, the facing contact tabs 15*a*, 17*a* and 16*a*, 18*a* are joined together in electrically contacting manner by the bus bars 6, 8. In other words, the contact tabs 15*a* and 17*a* are connected to the bus bar 6, and the contact tabs 16*a* and 18*a* too the bus bar 8. In FIG. 3 the upper first contact tabs 15*a* and 16*a* are represented without plug element 21, while the lower second contact tabs 17*a* and 18*a* are forced apart by the pin element 24.

Figure 4C:
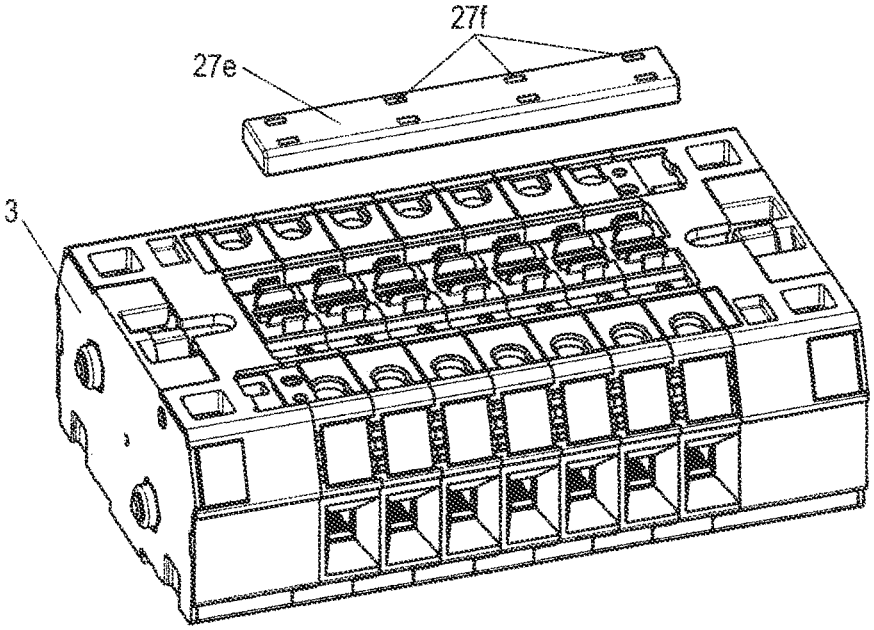
FIGS. 4*c* and 4*d* are perspective views of the terminal block assembly in partially-exploded and assembled conditions, respectively.
Figure 4D:
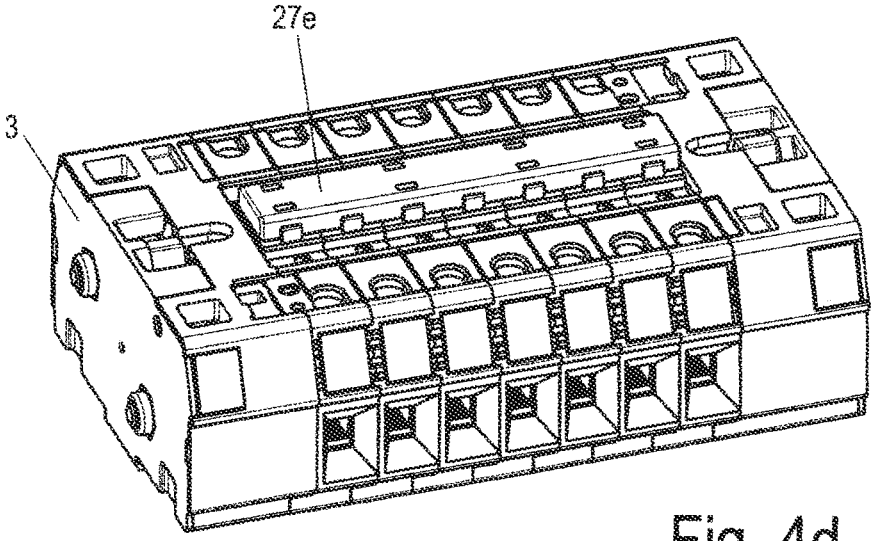
Figure 4E:
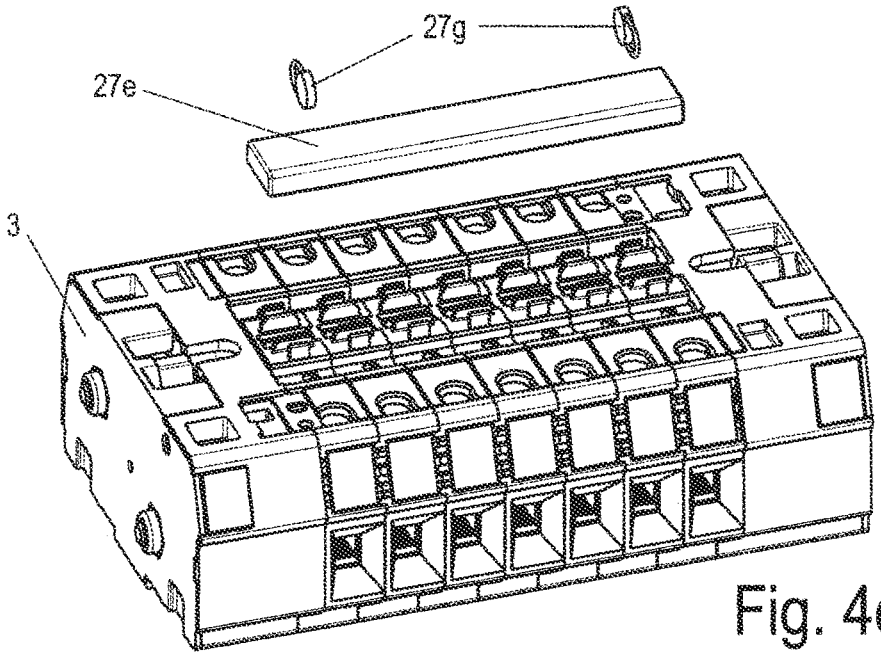
FIGS. 4*e* and 4*f* are perspective views of another embodiment of the terminal block assembly in partially-exploded and assembled conditions, respectively.
Figure 4F:
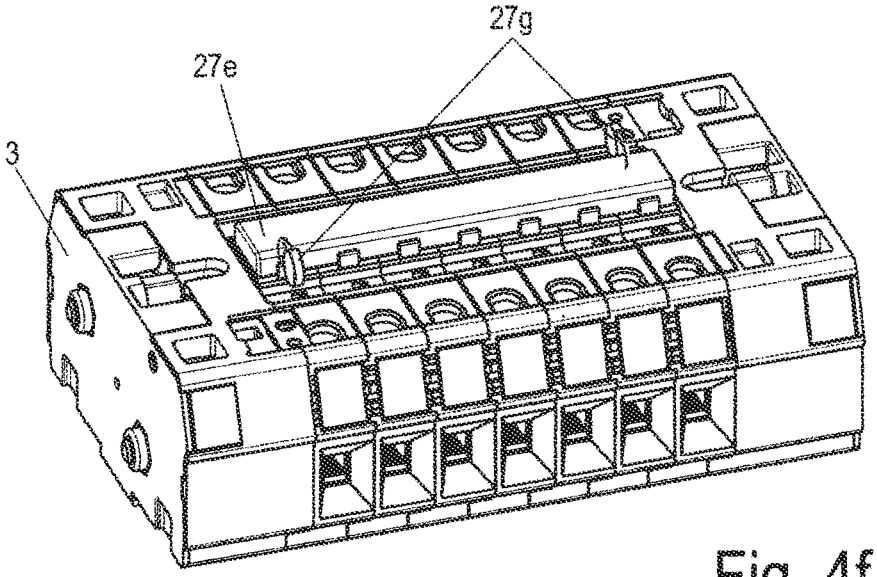

As shown in FIGS. 4*a* and 4*b*, the terminal block assembly includes two sliding protective members 27 mounted in guides 4*c* for sliding movement by tool 28 between a first dust-protecting covering position (FIG. 4*a*) above the access openings 9 and 10, and an uncovered open position (FIG. 2*b*). In the open position of FIG. 4*b*, openings 27*d* in the protective members are arranged above the access openings in the terminal blocks. As shown in FIG. 4*b*, conductive bridge members may be inserted into the access openings for engagement with the corresponding clamp devices, thereby to connect together selected ones of the terminal blocks. Further protective cover 27*e* containing detent openings 27*i* (FIGS. 4*c* and 4*d*) or seals 27*g* (FIGS. 4*e* and 4*f*) are provided to protect the center openings 19*a*.

Figure 5:
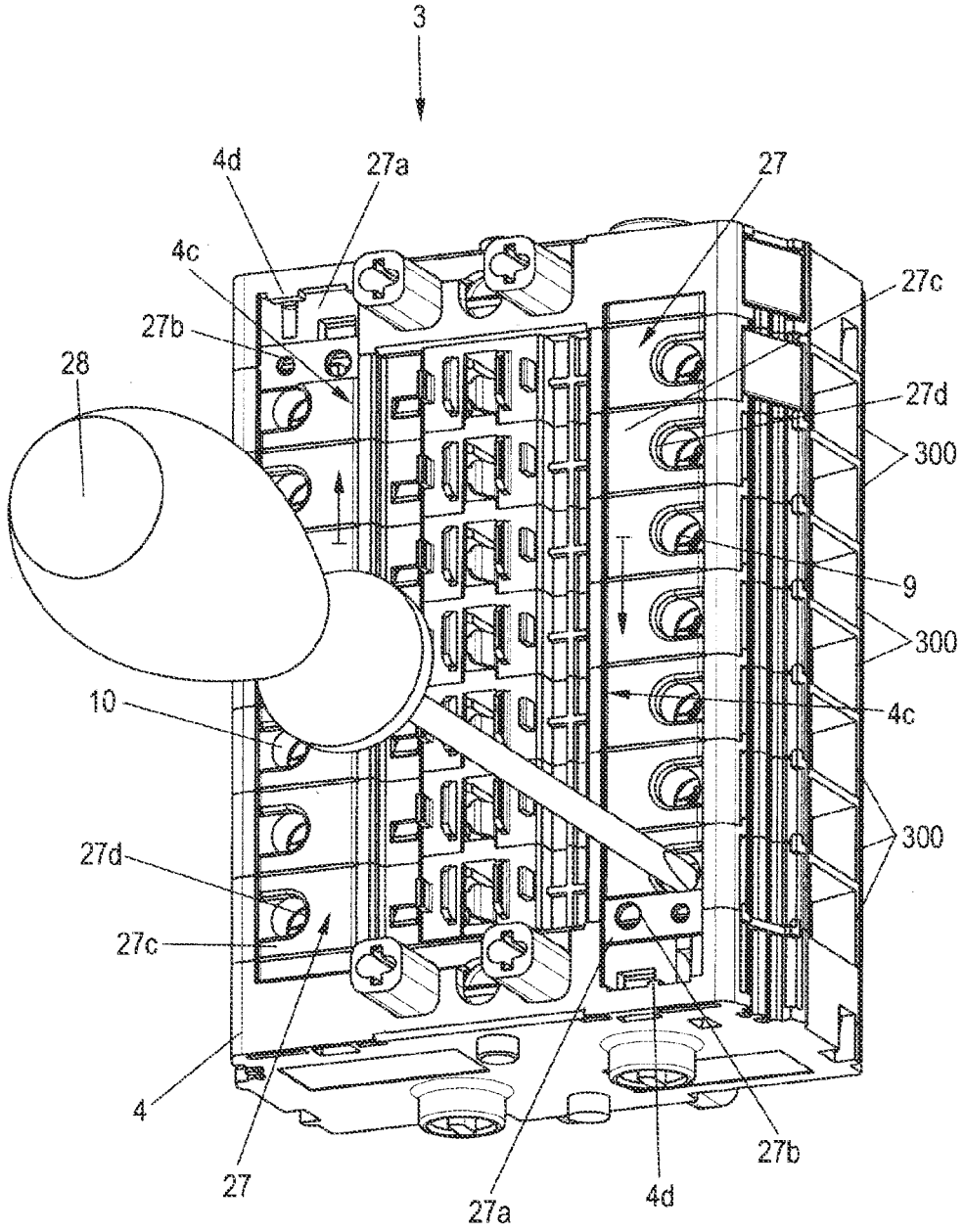
FIG. 5 is a top perspective view of the terminal block assembly, together with an operating tool for adjusting the protective covers when in the open position.

In FIG. 5, it will be seen that the protection elements 27 have been shifted so that the cover openings 27*d* of the cover fields 27*c* are arranged above the activating segments 9 and 10 of the clamping units 5, 7 and an access to the clamping units 5, 7 is possible, for example, with the tool 28 (i.e., a screwdriver). The activating parts 27*a* of the protection elements 27 are arranged here at a distance from the end stops 4*d* of the housing 4.

Figure 6:
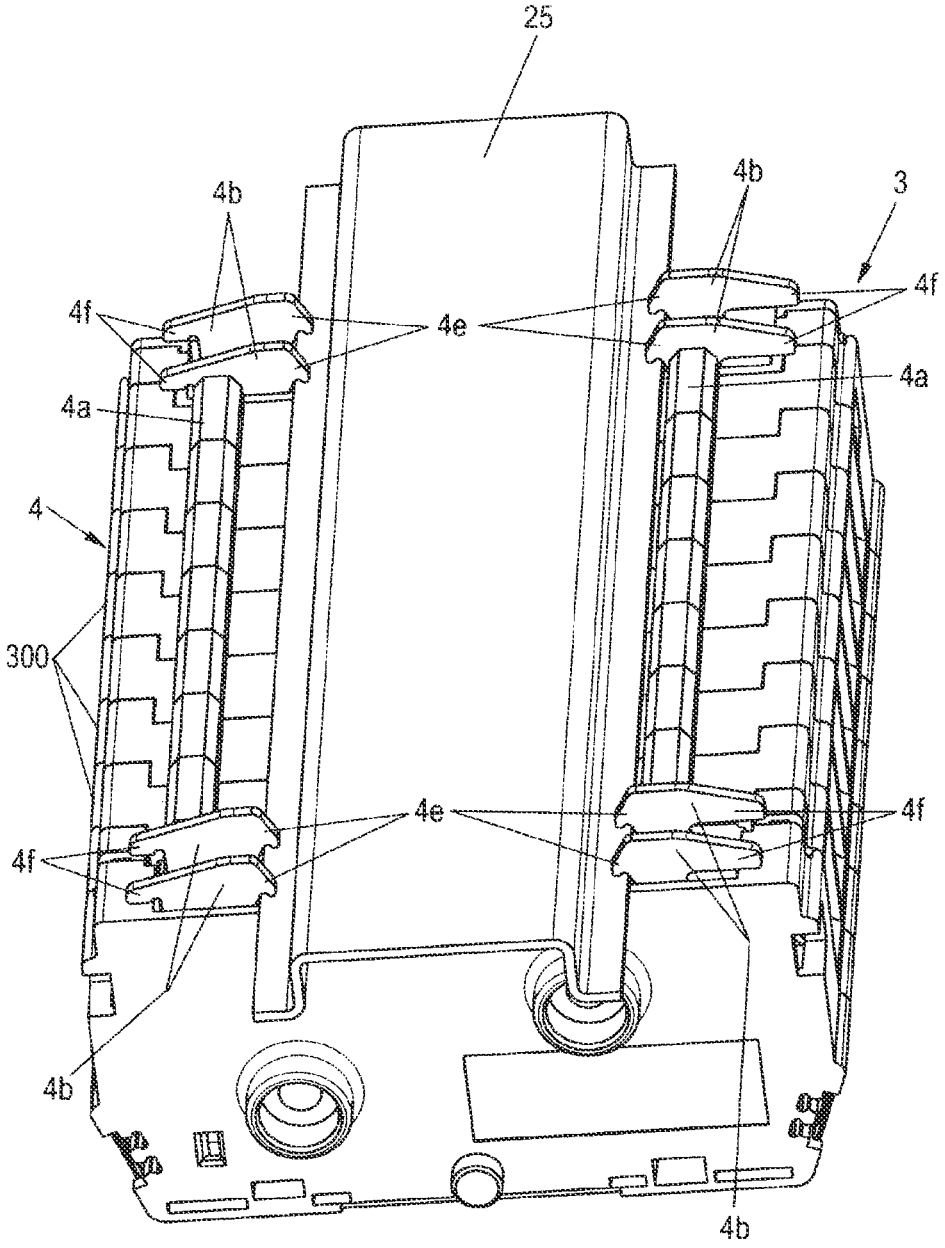
FIG. 6 is a bottom perspective view of the terminal block assembly when mounted on a mounting rail.

In the bottom perspective view of FIG. 6, it will be seen that the terminal block assembly 3 is mounted on the mounting rail 25 by two pairs of mounting feet that extend downwardly at each end of the assembly. Each support foot 4*b* has one end pointing inward toward the mounting rail 25 with a mounting rail support section 4*e* in the form of a lug. At the other ends, each of which points outward, the support feet s 4*b* are configured with arm-like bracket sections 4*f*. These support feet are arranged at the lower edge portions of the end support members 400 (FIG. 8*a*). During the mounting of the assembly 3 on the mounting rail 25 as shown in FIG. 6, the assembly 3 is held on the mounting rail 25 by means of the mounting rail support sections 4*e* of the support feet, as the mounting rail support sections 4*e* reach around a segment of the mounting rail 25. For this, the holders 4*b* can be inserted or locked in corresponding recesses of the housing 4 in the position shown after the connection device 3 has been placed in them, or they can be shoved toward each other in the direction of the mounting rail 25 to create the reaching across the mounting rail support section 4*e*. But the connection device 3 can also be shoved onto the mounting rail 25 in its longitudinal direction. Other options are conceivable, of course.

Figure 7:
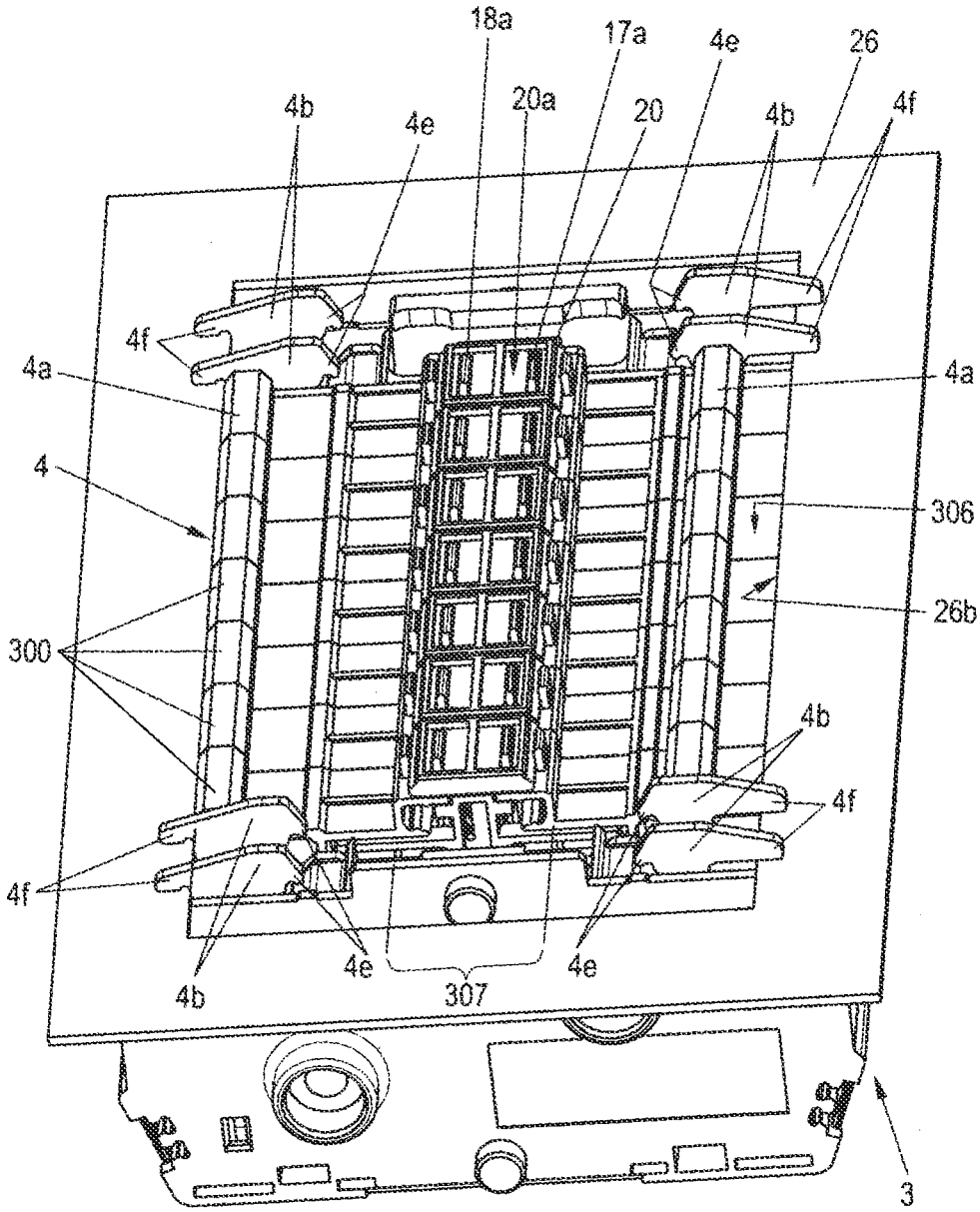
FIG. 7 is a bottom perspective view of the terminal block assembly when mounted in a wall opening.

In FIG. 7, the terminal block assembly 3 is supported by the lug portions 4*f* of the mounting feet 4*b* in the wall opening 26*b*. In this arrangement, the mounting fee 4*b* and the center portion 307*a* of the assembly extend below the plane of the horizontal wall 26.

Figure 8B:
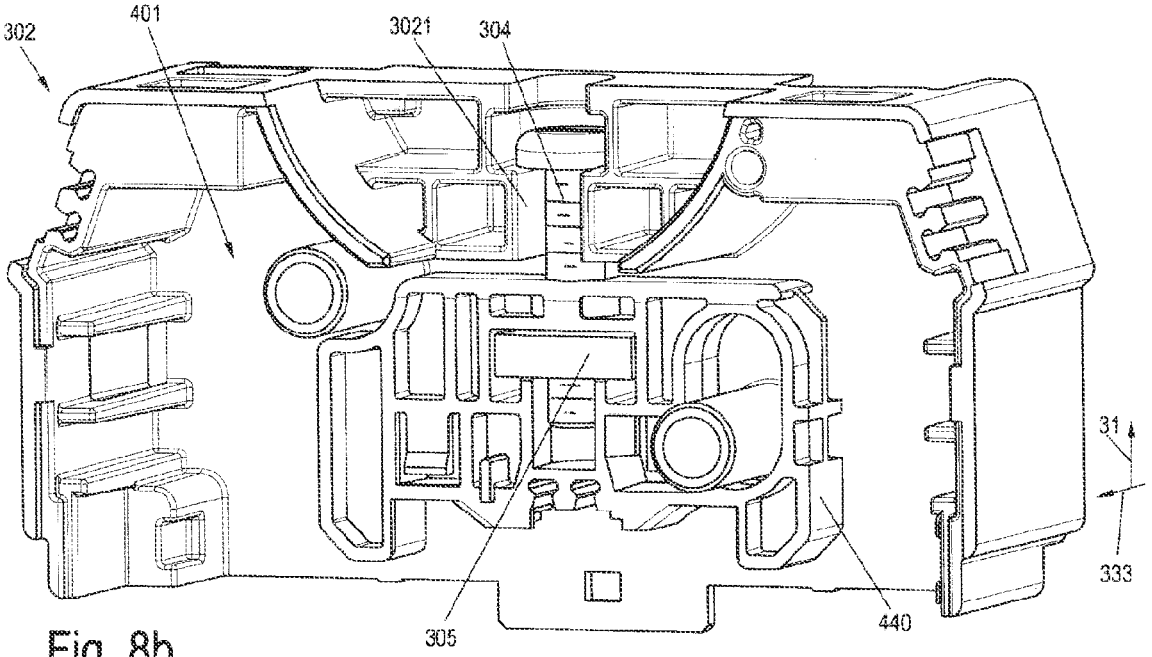
FIGS. 8*b* and 8*c* are detained perspective views of the end support member arrangement.
Figure 8C:
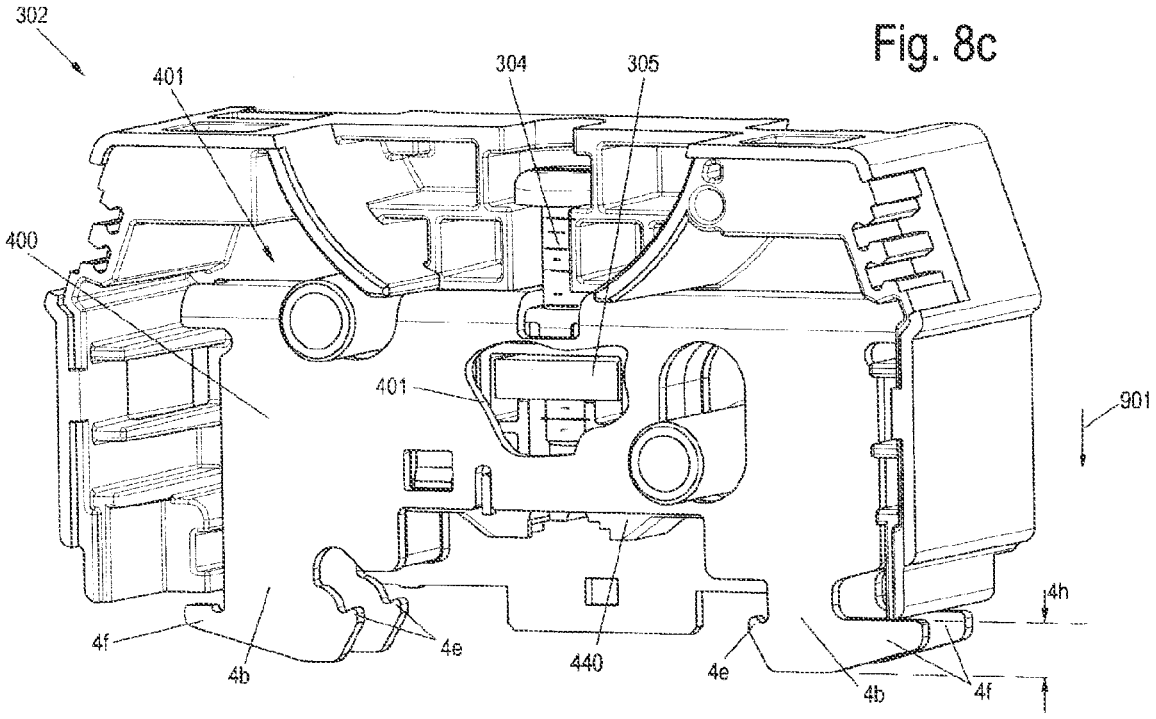
Figure 8D:
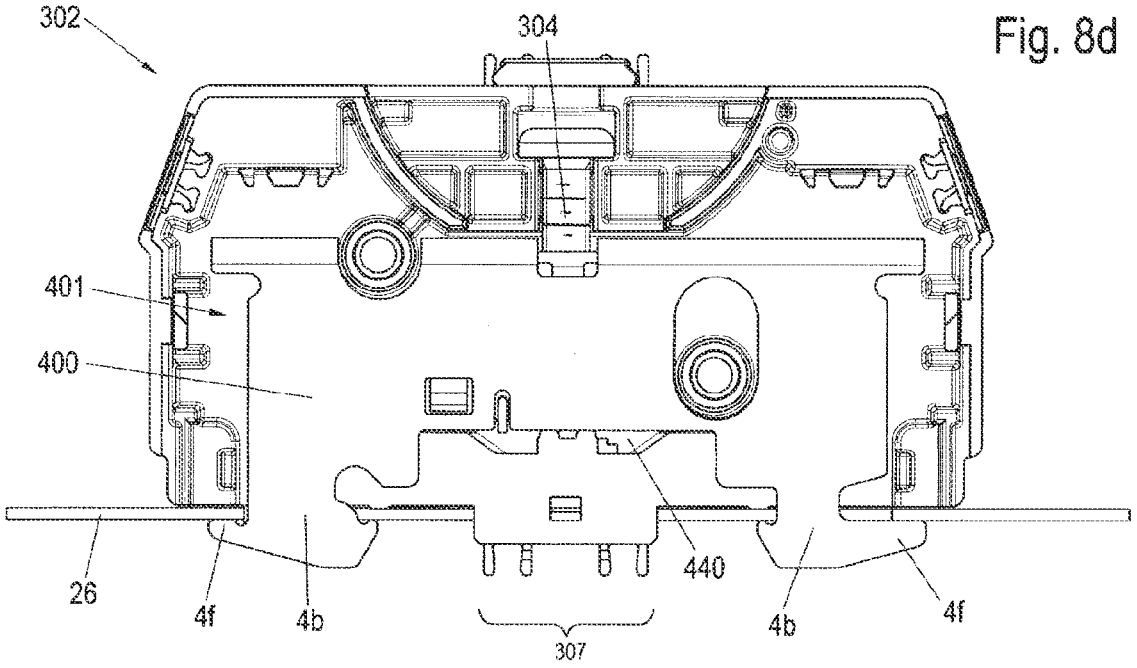
Figure 8E:
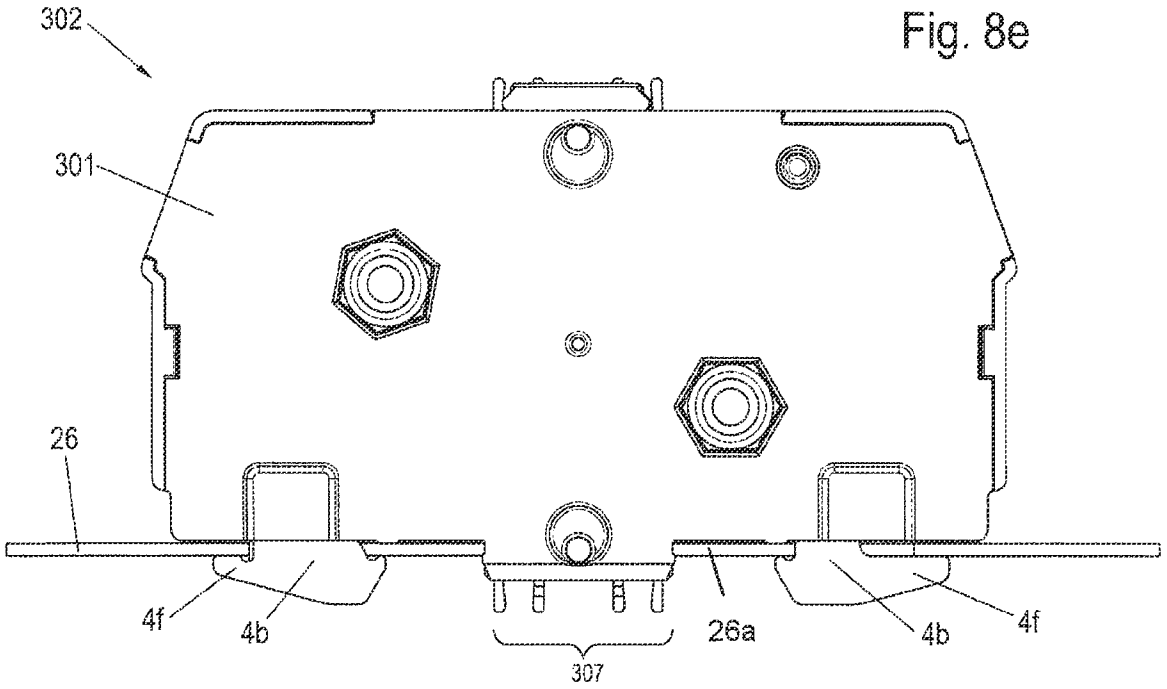
Figure 8F:
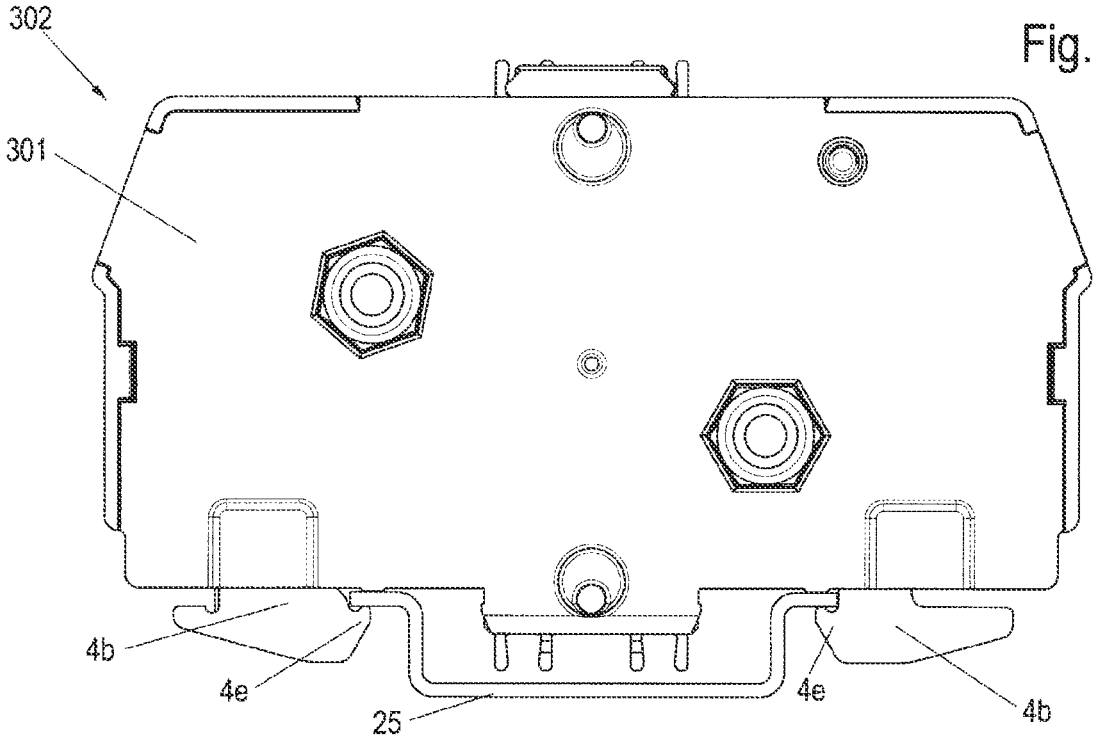

Referring now to FIG. 8*a*, the stacked terminal blocks 300 are assembled by assembling means 4 including end connecting units 302 arranged at opposite ends of the stack, which end units are connected by connecting rods 450 that extend longitudinally through aligned openings contained in the terminal blocks. Each end unit includes a four-sided body member that cooperates with an end locking plate 301 to define a chamber 307 that is open at its bottom. The locking nuts 451 at the ends of the locking rods 405 are retained against rotation by the corresponding non-circular openings contained in the locking plate 301. Mounted for vertical displacement in this chamber is an inverted U-shaped end support member 400 which includes at it lower portion two pairs of downwardly-extending support feet 4*b*. Arranged within the support member 400 is an adjustment element 440 (FIG. 8*b*) that is vertically displaceable by the cooperation between adjusting screw 304 and nut 305. Therefor, upon tightening of the screw 304, the adjusting element 440 and the support member 400 are displaced upwardly (FIG. 8*d*) to bring the support feet 4*b* and the bottom of the assembly into tight engagement with the lower and upper surfaces of the horizontal wall 26. It will be seen that in this wall-mounted arrangement, the assembly center contact area 307 and the support feet 4*b* extend below the lower surface of the support wall 26. Similarly, in the mounting rail arrangement of FIG. 8*f*, the mounting feet 4*b* extend below the mounting rail outwardly-directed flange portions, and the assembly lower center portion extends within the mounting rail chamber.

Figure 8G:
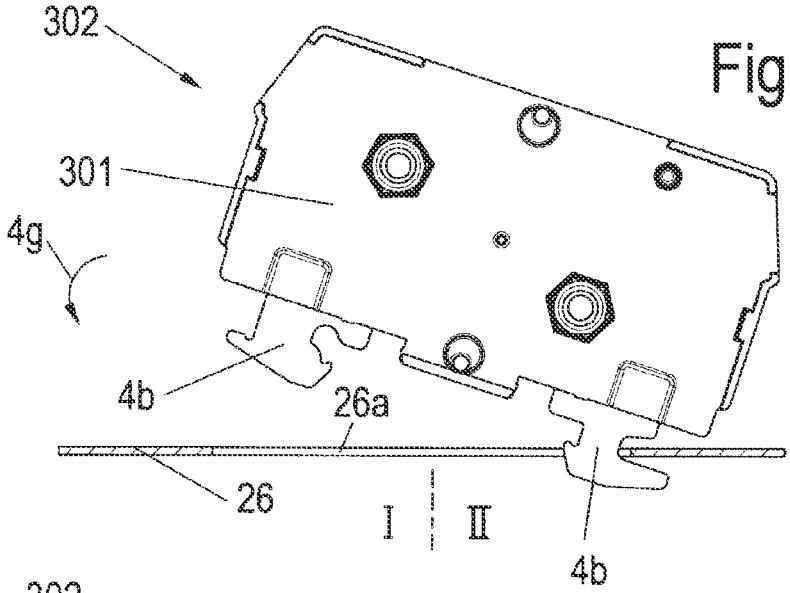
Figure 8H:
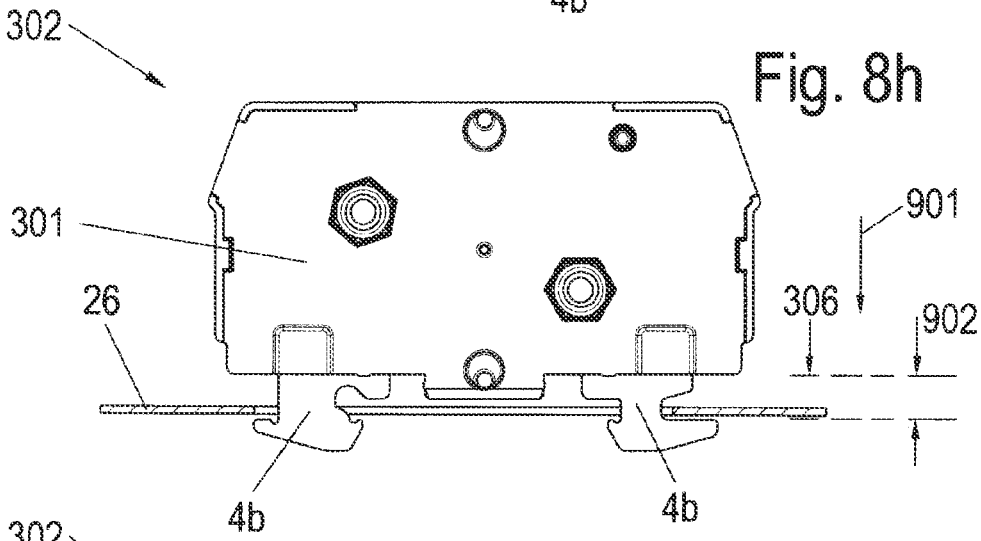
Figure 8I:
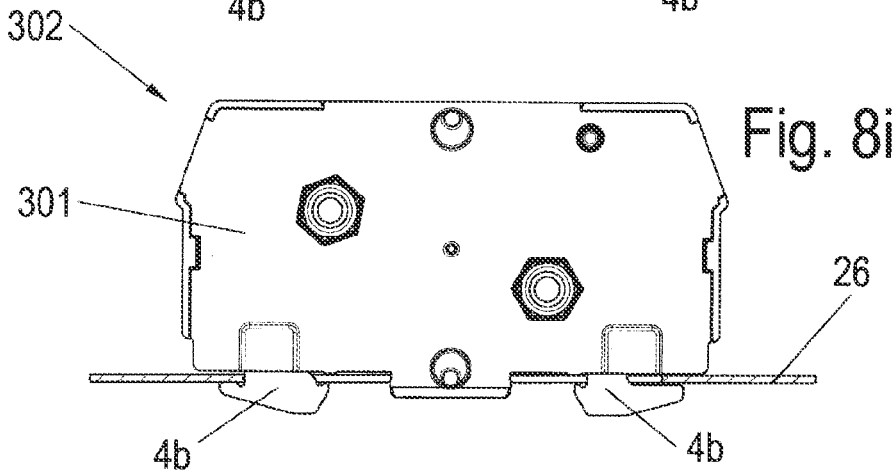

As shown in FIGS. 8*g* and 8*h*, when the support member 400 is in the lower connecting position with the support feet 4*b* extending below the end member housing 302, the assembly is tilted (FIG. 8*g*) to effect engagement of the right hand support feet with the associated edge of the opening 26*a* contained in the wall surface 26. The assembly is then tilted downwardly to the horizontal position, and is shifted slightly to the left (FIG. 8*h*) so that the remote lug portions of the support feet extend under the lower surface of wall 26. Screw 304 is then operated to draw the support member 400 and the support feet 4*b* upwardly toward the locked position of FIG. 8*i*.

Referring now to FIGS. 9*a*-9*c*, in order to mount the terminal block assembly 3 on an imperforated wall surface 900, an adapter plate 95 is provided that is secured (for example, adhesively or by screw means) to the upper surface of the wall. The lower surface 306 of assembly 3 is then seated on the upper surface 93 of the adapter plate 95 (FIG. 9*c*), with the support feet 4*b* and the lower center portion 307 of the assembly being received within the cutout opening 90 (FIG. 9*a*) contained in the adapter plate. To this end, the height 4*h* (see FIG. 8*c*) of these elements 4*a*, 4*b*, 307 is less than the thickness 91 of the adapter plate 95 (see FIG. 9*c*), so that the adapter plate 9 completely receives up the elements 4*a*, 4*b*, 307 when the terminal block assembly 3 is mounted on the adapter plate 95. The components are then fastened together by the fastening screws 304.

As can be seen in FIGS. 9*a* and 9*c*, the surface contour of the bottom side 306 of the connection device 3 is configured corresponding to a surface contour of the adapter plate 9 at its side 93 facing the terminal block assembly 3. The cutout opening 90 is surrounded all around by a margin region formed here by the adapter plate 95. In this way, the connection device 3 in the embodiment shown here lies by its entire surface against the adapter plate 95, so that a penetration of dust and moisture into the cutout 90 is prevented. Yet it is also conceivable for the assembly 3 to lie against the adapter plate 9 only in line-shaped or spot-like regions (not shown), or for the adapter plate 9 to have recesses (not shown) in which the connection device 3 does not lie against it.

Figure 10A:
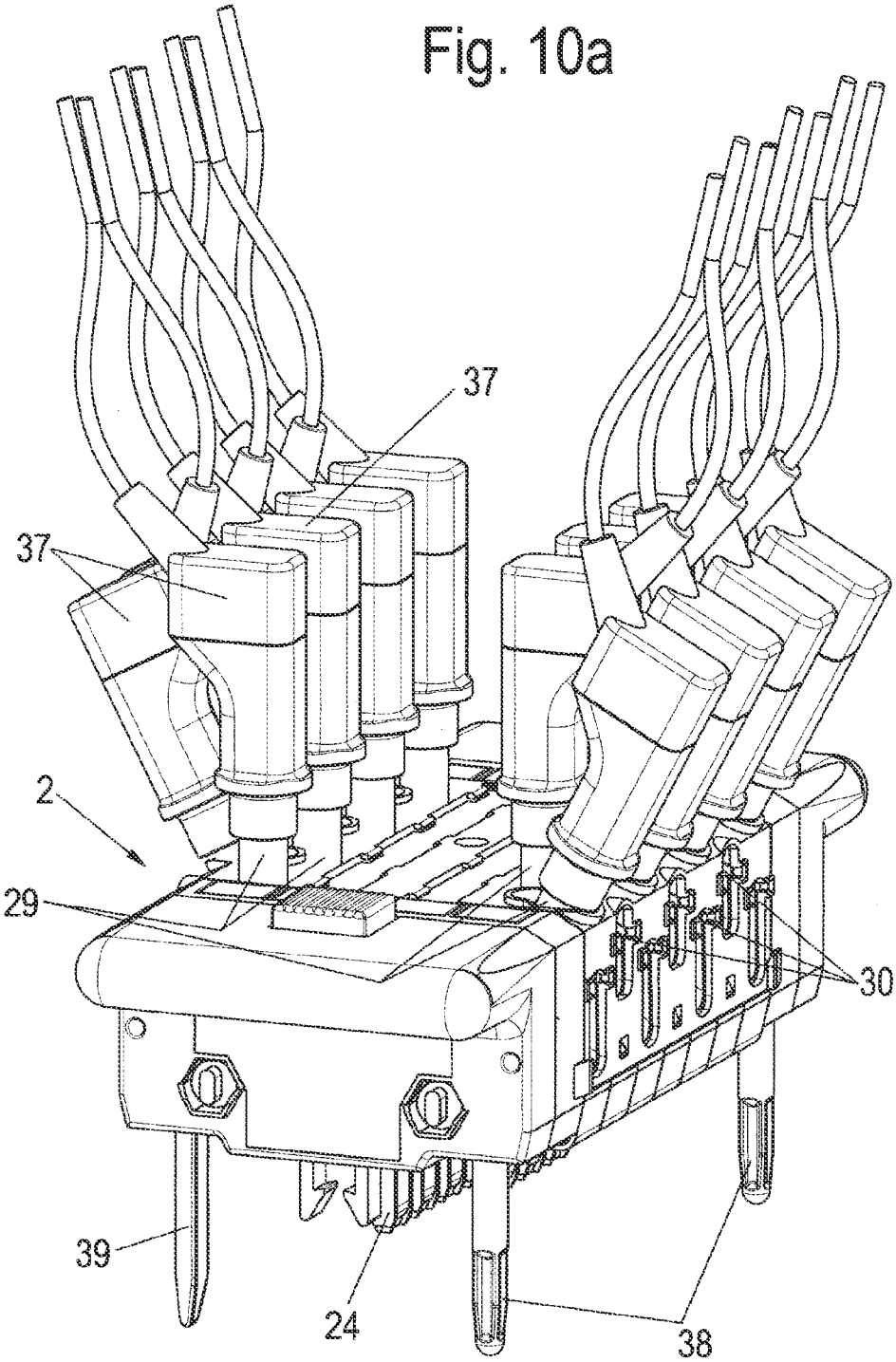
FIG. 10*a* is a perspective view of the testing device.

FIG. 10*a* shows a perspective view of the testing device 2. In the first measuring points 29 of the testing device 2 there are arranged probes 37. The first measuring points 29 are arranged at an angle to each other. This allows for an easy arrangement of relatively large probes 37. To simplify the inserting and positioning of the testing device 2, inserting feet 38, 39 are provided, one of which differs in its cross section. Thanks to this encoded insert foot 39, a wrong arrangement of the testing device 2 in the connection device 3 is prevented.

A contact protection cover 8 is provided for the unused testing device 2, in which the testing device 2 can be inserted. The contact protection cover 8 has first and second recesses 80, 81 to protect the inserting feet 38 and the encoded insert foot 39 as well as the pin elements 24.

Figure 10B:
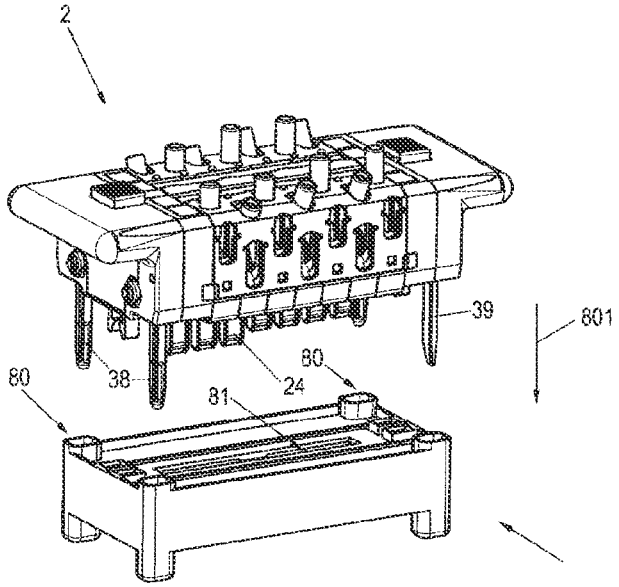
FIGS. 10*b* and 10*c* are perspective views illustrating the testing device in an exploded and assembled condition, respectively, relative to a protective cover.
Figure 10C:
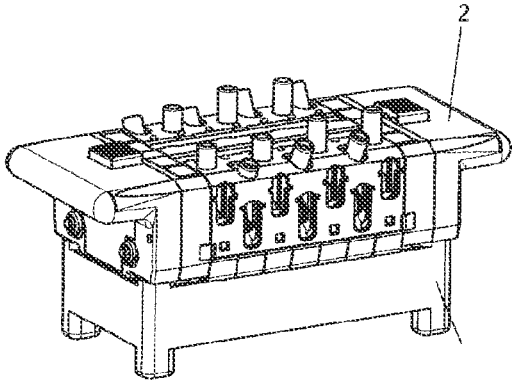

FIGS. 10*b* and *c* show the arranging of the testing device 2 in the contact protection cover 8 in the insert direction 801, while FIG. 10*c* shows the testing device 2 inserted into the contact protection cover 8.

While in accordance with the provisions of the Patent Statutes the preferred forms and embodiments of the invention have been illustrated and described, it will be apparent to those skilled in the art that changes may be made without deviating from the invention described above.

What is claimed is:

1. A terminal block arrangement, comprising:

(a) a plurality of generally rectangular terminal blocks (300) having vertical parallel side walls, vertical end walls, and horizontal top and bottom walls;

(b) a connecting arrangement (4) connecting said terminal blocks in contiguous side-by-side stacked relation, thereby to define a terminal block assembly (3) in which at least portions of said terminal block top and bottom walls are exposed; and (c) fastening means (4*b*; 95) for fastening the bottom portion of said terminal block assembly to a fixed support, wherein a pair of end connecting units (302) are arranged at opposite ends of the stacked terminal blocks and the end units are locked together by locking means (301, 450 and 451).

2. A terminal block assembly as defined in claim 1, wherein each of said end connecting units includes:

(a) a hollow rectangular end member (302*a*) having a vertical side wall and a pair of vertical end walls that cooperate to define a chamber (401) that is open at its bottom and at one side;

(b) a rectangular locking plate (301) arranged to close the open side of said chamber; and (c) a generally rectangular end support member (400) arranged between and parallel with said locking plate and said end member side wall, said support member having a bottom portion including at opposite ends a pair of coplanar spaced support feet (4*b*) that extend downwardly out of said chamber, said support feet being adapted for connection with said fixed support;

and further wherein said locking means includes:

(a) at least one horizontal locking rod (450) extending longitudinally successively through a first one of said end connecting units, through said stacked terminal blocks, and through the other one of said end connecting units; and (b) locking nuts (451) threadably connected with the ends of said locking rods.

3. A terminal block assembly as defined in claim 2, wherein said end support member is mounted for vertical displacement on said locking rod; and further wherein said fastener means includes a screw arrangement (304, 440) for vertically displacing said end support member between a lower extended connecting/disconnecting position and an upper fastening position relative to said end connecting unit, respectively.

4. A terminal block assembly as defined in claim 3, wherein said fixed support comprises a generally inverted hat-shaped mounting rail (25) arranged longitudinally below and parallel with said terminal block arrangement between said support feet, said mounting rail having outwardly extending horizontal flange portions that extend within recesses defined by inwardly directed projecting portions (4*e*) of said support feet.

5. A terminal block assembly as defined in claim 3, wherein said fixed support comprises a wall (26) containing a generally rectangular wall opening (26*a*) having a pair of opposed side edges; and further wherein said terminal block arrangement is positioned with its lower portion extending into said wall opening, said support feet having at their remote ends outwardly extending portions (4*f*) that define slots receiving said opening opposed side edges, respectively.

6. A terminal block assembly as defined in claim 3, wherein said support member (400) has an inverted generally U-shaped configuration defining a pair of parallel spaced vertical legs connected by a transverse top portion, each of said side walls including at its lower edge portion a pair of said support feet; and further wherein said screw arrangement includes a vertical adjusting member (440) arranged between the side legs of said end support member, and a screw (304) that extends downwardly through and opening contained in said support member transverse portion, said screw having a threaded lower portion that extends into a threaded opening contained in said adjusting member.

7. A terminal block assembly as defined in claim 2, wherein said fixed support comprises a horizontal imperforate planar wall (900); and further including:

(d) a horizontal adapter plate (95) secured to the upper surface of said wall, said adapter plate having an upper surface (93) upon which the bottom surface (306) of said terminal block assembly is seated, said adapter plate having a thickness (91) that is greater than the height (4*h*) of said support feet, said adapter plate containing a rectangular opening (90) receiving the terminal block assembly bottom portion (307) and said support feet (4*b*) at opposite ends of said terminal block assembly; and (e) a plurality of adapter screws (304') for fastening said terminal block assembly to said adapter plate.

8. A terminal block assembly as defined in claim 7, wherein said terminal block bottom surface (306) has a surface contour that corresponds with the contour of the upper surface (93) of said adapter plate.

* * * * *